US006578487B2

(12) United States Patent
Avetisian et al.

(10) Patent No.: US 6,578,487 B2
(45) Date of Patent: Jun. 17, 2003

(54) PYROTECHNIC INITIATOR WITH A NARROWED SLEEVE RETAINING A PYROTECHNIC CHARGE AND METHODS OF MAKING SAME

(75) Inventors: Vahan Avetisian, Newbury Park, CA (US); Todd Rosin, Simi Valley, CA (US)

(73) Assignee: Special Devices, Inc., Moorpark, CA (US)

( * ) Notice: Subject to any disclaimer, the term of this patent is extended or adjusted under 35 U.S.C. 154(b) by 0 days.

(21) Appl. No.: 09/733,755

(22) Filed: Dec. 8, 2000

(65) Prior Publication Data

US 2002/0069782 A1 Jun. 13, 2002

(51) Int. Cl.[7] ..... F42B 3/10; F42C 19/12

(52) U.S. Cl. ..... 102/202.7; 102/202.5; 102/202.9; 102/530

(58) Field of Search ..... 102/202.9, 202.7, 102/202.5, 530, 202.14

(56) References Cited

U.S. PATENT DOCUMENTS

| | | | | | |
|---|---|---|---|---|---|
| 2,393,629 | A | * | 1/1946 | Grant, Jr. | 102/202.7 |
| 2,400,103 | A | * | 5/1946 | Cobb | 102/202.9 |
| 3,101,669 | A | * | 8/1963 | Gatley et al. | 102/202.9 |
| 3,128,703 | A | * | 4/1964 | Bryan | 102/202.14 |
| 3,306,202 | A | * | 2/1967 | Menichelli et al. | 102/202.14 |
| 5,140,906 | A | * | 8/1992 | Little, II | 102/202.14 |
| 5,433,147 | A | * | 7/1995 | Brede et al. | 102/202.9 |
| 5,576,509 | A | * | 11/1996 | Refouvelet et al. | 102/202.7 |
| 5,621,183 | A | * | 4/1997 | Bailey | 102/202.7 |
| 5,686,691 | A | | 11/1997 | Hamilton et al. | 102/202.5 |
| 5,763,814 | A | * | 6/1998 | Avory et al. | 102/202.7 |
| 5,932,832 | A | * | 8/1999 | Hansen et al. | 102/202.9 |
| 5,988,069 | A | * | 11/1999 | Bailey | 102/202.9 |
| 6,106,008 | A | * | 8/2000 | Blackshire et al. | |
| 6,295,935 | B1 | * | 10/2001 | Swann et al. | 102/202.14 |
| 6,338,500 | B1 | * | 1/2002 | Perotto | 102/202.5 |

* cited by examiner

*Primary Examiner*—Charles T. Jordan
*Assistant Examiner*—Lulit Semunegus
(74) *Attorney, Agent, or Firm*—Law Offices of Thomas J. Brindisi

(57) ABSTRACT

A pyrotechnic initiator with a narrowed sleeve attached to a header assembly and retaining a pyrotechnic charge, and methods of making same.

20 Claims, 1 Drawing Sheet

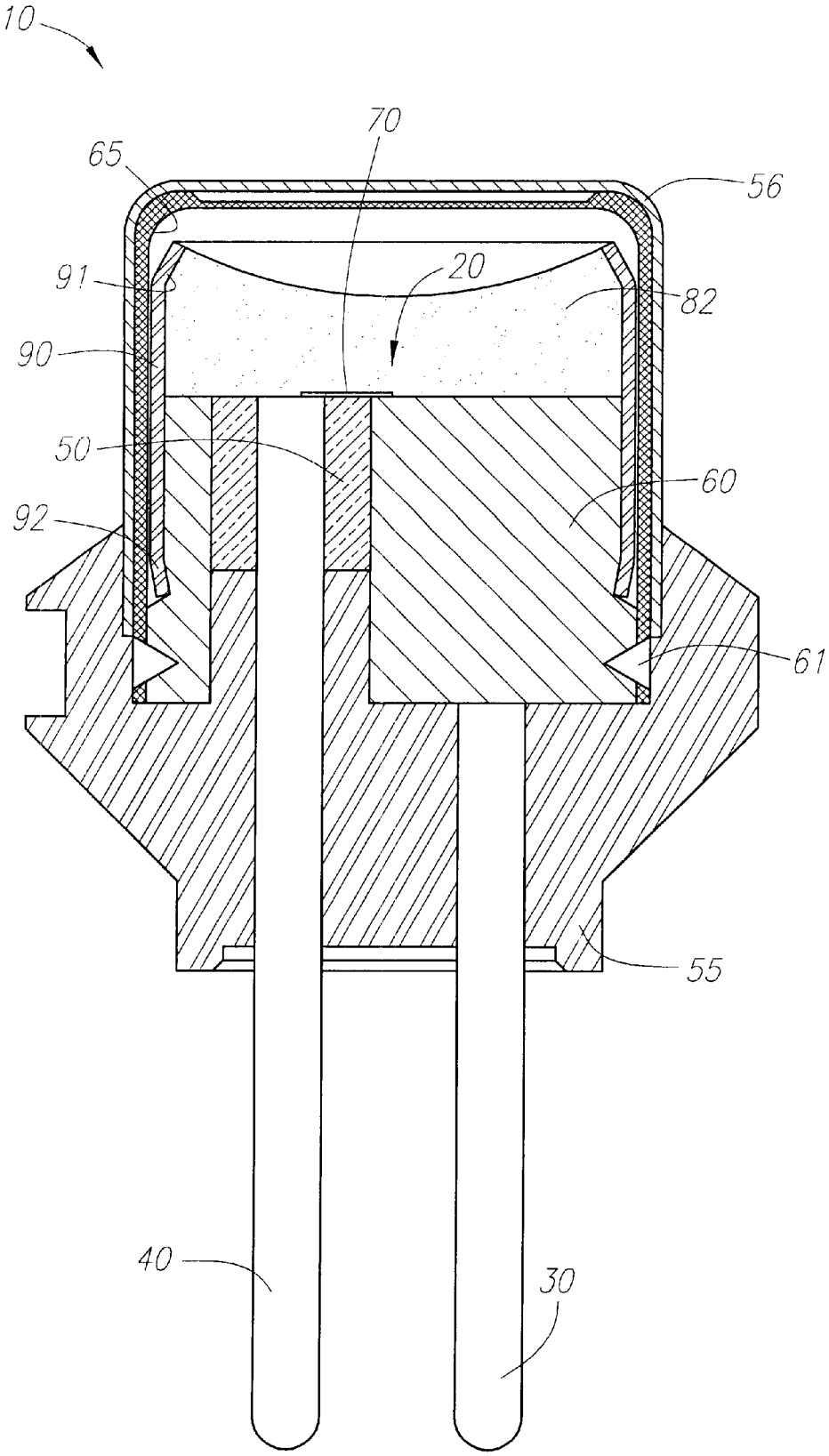
10
70
65
56
91
20
82
90
50
60
92
61
55
40
30

PYROTECHNIC INITIATOR WITH A NARROWED SLEEVE RETAINING A PYROTECHNIC CHARGE AND METHODS OF MAKING SAME

BACKGROUND OF THE INVENTION

The present invention generally relates to the field of pyrotechnic initiators, and more particularly to a pyrotechnic initiator having a crimped sleeve for retaining a pyrotechnic charge.

Pyrotechnic initiators have many uses in industrial and consumer applications. One important use is in triggering the inflation of airbags in motor vehicles. Significant efforts have been made in the automotive industry to reduce the cost of manufacturing reliable airbag initiators. One advance has been the use of liquids and slurries in loading pyrotechnic charges into the initiators. There remains a substantial need for further reduction in the costs of manufacturing reliable initiators, however, and hitherto, a narrowed sleeve has never been used to retain a pyrotechnic charge in an initiator.

SUMMARY OF THE INVENTION

In accordance with the present invention, a sleeve with a narrowed end retains a pyrotechnic charge in place in an initiator.

BRIEF DESCRIPTION OF THE FIGURE

The FIGURE is a sectional view of an embodiment of the present invention.

DETAILED DESCRIPTION OF A PREFERRED EMBODIMENT

Various initiator configurations can be used, or modified appropriately for use, in the present invention. As can be seen from the FIGURE, a preferred embodiment of an initiator 10 according to the present invention includes a number of features typically found in a pyrotechnic initiator. For example, there is a molded insulating body 55, and a coaxial sealed header assembly 20 hermetically attached to a can 65 that is surrounded by an insulator cup 56. The depicted coaxial header assembly 20 in turn consists of a coaxial, isolated center pin 40, glass 50, an eyelet 60, a welded bridgewire 70, and a ground pin 30, with both of pins 30 and 40 extending beyond body 55 to form a connector end.

In the depicted embodiment of the present invention, however, the lower region of a preferably uniformly cylindrical sleeve 90 is slid onto eyelet 60 until approximately the upper half or third of sleeve 90 remains above the top surface of header assembly 20. Then, the lower end 92 of sleeve 90 is circumferentially crimped inwardly along a corresponding circumferential indentation in eyelet 60, so as to firmly secure sleeve 90 onto eyelet 60. Other suitable methods, such as welding, can also be used to secure the sleeve.

Following that, preferably substantially the entire open area within sleeve 90 (i.e., the area within the aforementioned upper half or third that remains above the top surface of header assembly 20) is loaded with a suitable pyrotechnic charge 82. Preferably, this is done using a slurry loading technique or similar means known in the art. Some examples of relevant slurry-loadable pyrotechnic compositions are described in U.S. Pat. No. 5,686,691 to Hamilton, et al., the disclosure of which is incorporated herein by reference as if set forth in full. Preferably after (although, less preferably, it could be done before or during) drying of the slurry, the upper end 91 of sleeve 90 is circumferentially crimped inwardly so that it becomes narrowed and compresses charge 82. During or after this step, the top of charge 82 is preferably (although it is not necessary) pressed downwardly to pack charge 82 more tightly and more firmly press it against bridgewire 70. Pressing preferably produces a concave top on charge 82 (as shown in the FIGURE), although the top of charge 82 could alternately be formed flat or even project convexly above the top of sleeve 90.

Although sleeve 90 is preferably loaded after it is attached to the header assembly as just described, sleeve 90 could alternately be separately pre-loaded (preferably with a slurry, and preferably upside-down on a flat surface or suitable fixture) with charge 82 (so as to fill the desired portion of the upper region of sleeve 90). Then (preferably after drying of slurry), the top of header assembly 20 could be inserted into sleeve 90 such that the bottom of charge 82 makes intimate contact with bridgewire 70. The lower end 92 of sleeve 90 could then be firmly affixed to eyelet 60 and the upper end 91 of sleeve 90 crimped inwardly, as described above.

Alternately still, rather than forming the narrowed upper end 91 of sleeve 90 by crimping it after loading sleeve 90, sleeve 90 could be formed with a narrowed end right from the outset, and the slurry charge just loaded and allowed to dry in the sleeve without the need for crimping the sleeve. This is less preferable, however, than forming the narrowed end after the slurry has dried within the sleeve.

In any case, once the slurry dries, the resulting pyrotechnic charge 82 is physically retained in place by sleeve 90. Specifically, the obstruction of narrowed upper end 91 (which has a smaller inner diameter than the outer diameter of charge 82 below narrowed upper end 91), and the cohesion and/or friction between charge 82 and the walls of sleeve 90, retain charge 82 in intimate contact with bridgewire 70 (or other suitable electrical initiating element). Thus, the process of assembling the pyrotechnic charge 82 to the header assembly 20 in intimate contact with bridgewire 70 is simplified and yet more reliable.

Subsequently, the resulting initiator subassembly (including the header assembly 20 and the sleeve 90 loaded with the pyrotechnic charge 82) is pressed into and hermetically sealed and attached to can 65, such as with a through-weld 61. The interior of can 65 is depicted in the FIGURE as not in contact with the upper end 91 of sleeve 90, however, the interior of can 65 could alternately be in contact with upper end 91 of sleeve 90 if desired. To complete initiator 10, a suitable insulator cup 56 and insulating body 55 are provided as is well known in the art.

A preferred embodiment of a pyrotechnic initiator having a narrowed sleeve retaining a pyrotechnic charge, and many of its attendant advantages, has thus been disclosed. It will be apparent, however, that various changes may be made in the form, construction, and arrangement of the parts without departing from the spirit and scope of the invention, the form hereinbefore described being merely a preferred or exemplary embodiment thereof. Therefore, the invention is not to be restricted or limited except in accordance with the following claims.

What is claimed is:

1. A pyrotechnic initiator subassembly, comprising:

a) a header assembly including an eyelet, a top surface, and an exposed electrical initiating element on said top surface;

b) a cylindrical, open-ended sleeve attached to said eyelet and projecting upwardly above said top surface of said eyelet, said sleeve having a narrowed upper end;

c) a pyrotechnic charge within said sleeve, said charge having a largest outer diameter that is greater than the inner diameter of said narrowed upper end of said sleeve, and said charge being in firm contact with said sleeve and said exposed electrical initiating element; and, d) a can sealed to said eyelet, said can surrounding said sleeve and said charge.

2. The initiator subassembly of claim 1, wherein said charge has a top surface that is concave.

3. The initiator subassembly of claim 1, wherein said electrical initiating element is a bridgewire.

4. The initiator subassembly of claim 1, wherein said can is not in contact with said narrowed upper end of said sleeve.

5. The initiator subassembly of claim 1, further comprising an insulating initiator body attached to said header assembly.

6. The initiator subassembly of claim 1, wherein said header assembly includes a coaxial header.

7. The initiator subassembly of claim 6, further comprising an insulating cup surrounding said can.

8. The pyrotechnic initiator subassembly of claim 1, wherein said narrowed upper end of said sleeve is gradually tapered inwardly.

9. A method for making a pyrotechnic initiator subassembly, comprising the steps of:

a) providing a header assembly including a top surface, an eyelet, and an electrical initiating element, said eyelet having an outer diameter, and said electrical initiating element residing exposed on said top surface;

b) providing a cylindrical, open-ended sleeve having an upper region and a lower region, said lower region having an inner diameter that is approximately the same as said outer diameter of said eyelet;

c) placing said lower region of said sleeve onto said eyelet and fixedly attaching said sleeve to said eyelet;

d) loading said upper region of said sleeve with a liquid or slurry pyrotechnic charge;

e) drying said liquid or slurry pyrotechnic charge;

f) providing a narrowed upper end to said upper region of said sleeve; and, g) attaching a can to said eyelet so as to surround said sleeve and said charge.

10. The method of claim 9, wherein step f) is performed after step d).

11. The method of claim 10, wherein step f) comprises circumferentially crimping the upper end of said sleeve.

12. The method of claim 9, wherein step d) is performed after step c), and step d) includes loading said charge such that said charge is in intimate contact with said electrical initiating element.

13. The method of claim 12, wherein step f) is performed after step d), and wherein step f) comprises circumferentially crimping the upper end of said sleeve.

14. The method of claim 9, wherein step c) is performed after step d), and step c) includes placing said sleeve such that said charge is in intimate contact with said electrical initiating element.

15. The method of claim 9, further comprising the step of pressing the top of said charge during or after step e).

16. The method of claim 15, wherein said further step of pressing includes pressing the top of said charge so as to produce a concave shape therein.

17. The method of claim 9, wherein step a) includes providing a header assembly wherein said electrical initiating element is a bridgewire.

18. The method of claim 9, wherein step c) includes crimping a portion of said lower region of said sleeve onto said eyelet.

19. The method of claim 9, wherein step f) is performed before step d), and wherein step b) includes step f).

20. The method for making a pyrotechnic initiator subassembly of claim 9, wherein step f) includes providing a gradually inwardly tapered narrowed upper end to said upper region of said sleeve.

* * * * *